US006454609B1

(12) United States Patent
Huang

(10) Patent No.: US 6,454,609 B1
(45) Date of Patent: Sep. 24, 2002

(54) SWITCHED MULTIPLE POWER OUTLET STRIP

(75) Inventor: Chyong-yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 22 days.

(21) Appl. No.: 09/862,607

(22) Filed: May 23, 2001

(51) Int. Cl.[7] ..... H01R 25/00; H01R 27/02; H01R 31/02; H01R 13/502; H01R 4/60

(52) U.S. Cl. ..... 439/652; 439/701; 439/214

(58) Field of Search ..... 439/652, 701, 439/650, 651, 188, 686, 214, 654

(56) References Cited

U.S. PATENT DOCUMENTS

| | | | | | |
|---|---|---|---|---|---|
| 4,379,605 | A | * | 4/1983 | Hoffman | 439/107 |
| 5,788,521 | A | * | 8/1998 | Milan | 439/101 |
| 6,015,307 | A | * | 1/2000 | Chiu et al. | 200/51.09 |
| 6,135,820 | A | * | 10/2000 | Chiang | 439/654 |
| 6,220,880 | B1 | * | 4/2001 | Lee et al. | 439/214 |

* cited by examiner

*Primary Examiner*—Brian Sircus
*Assistant Examiner*—Chandrika Prasad

(57) ABSTRACT

The present invention is a modularized compound receptacle structure of an external power supply unit that adapts a seat body provided for forming an assembly of three sets of conducting strips for plugging the conductors, wherein, the said seat body comprises at least more than two sets of receiving slots and a lapping body situated outside the receiving slots; the first conducting strip of the three sets of conducting strips is a strip body transversely crossing every receiving slot and disposed at the lapping body outside of the receiving slots; the second conducting strip is an independent strip body with equivalent number of receiving slots, an insert portion to be mounted in the receiving slot and an extending contact end; the third conducting strip is a strip body capable of transversely crossing every receiving slot, an insert portion corresponding to every receiving slot is formed on the strip body; thereby every set of the receiving slots of the seat body respectively accommodates the respective insert portions of the second and the third conducting strips so as to form an area for inserting the plugs; furthermore, the extending contact ends of the second conducting strip in every receiving slot are adjacent to but do not contact the first conducting strip thereby a switch area is formed between the said every contact end and the first conducting strip for providing the spontaneous contact of the additionally installed conducting members to communicate the circuit.

10 Claims, 19 Drawing Sheets

SWITCHED MULTIPLE POWER OUTLET STRIP

BACKGROUND OF THE INVENTION

1) Field of the Invention

The present invention relates to a modularized compound receptacle structure of an external power supply unit, more especially, a structure utilizing a modularized seat body to make a proper assembly of several conducting strips of the power supply unit to enable the insert construction composed by the conducting strips thereof to have multidirectional options, furthermore, to enable the lapped disposition of the switch components, the power indicator lights or the protective cover elements to coordinate multi-dimensionally and to efficiently reduce the volume of the power supply unit.

2) Description of the Prior Art

Accordingly, among the so called external power supply units, the extension cord receptacles are the most common ones; usually, the extension cord receptacles are designed as the expanded receptacles with more than one pair of receptacles; the basic form comprises several sets of plug hole seats disposed on the receptacle body and the design of corresponding and fitting switch components, thereby to form a seated switch receptacle; this kind of conventional seated switch receptacle seat mainly comprises several sets of plug hole seat modules on the receptacle body, each plug hole seat module is mounted with a corresponding switch component; one of the types of the said switch components often has power indicator light attached inside the switch button body or the switch itself is made to possess the loading and protective functions to control whether on not to conduct or supply the power of the corresponding plug hole seat of the said set by means of the switch component.

Observing the mentioned conventional seated extension cord switch receptacles, in order to make the assembly component convenient, they all use the independently manufactured plug hole seat modules and switch components to facilitate and fit the direct assembly of the receptacle bodies and, inside the receptacle bodies, several conducting strips in a state of series are arranged as the fire wires and the ground wires are conjoined to the conducting points of the plug hole seat modules and the switch components; however, although the independently manufactured plug-hole seat module and the switch component can facilitate the fitting of assembling and disposing the receptacle body, this module type has many limitations; first, since the said plug hole seat module and the switch component has respectively determined and relative volumes, the receptacle seat body must possess a certain size of volume for providing the assembling thus fails to be efficiently reduced to a miniaturized state; secondly, the said switch component is a device of fixed regulation, with or without the disposed power indicator light or the loading protector, the arrangement of the conducting circuit thereof is of determined pattern with no alternativity and is difficult to make designing change for advantageous type with the receptacle body and the plug hole seat module that makes the entire receptacle device incapable of leaping out of the conventional pattern and end up as an available and common device without uniqueness but insufficient market compatibility.

In view of the mentioned reasons, the inventor of the present invention, addressed that the seated extension cord switch receptacle truly needs a brand-new new alternation to break through the existing bottleneck, based on the experience gained from engagement in electronic device manufacturing, persistently programmed and researched for innovative improvement, following deliberated planning and design, finally culminated in the development of the present invention.

SUMMARY OF THE INVENTION

Therefore, the primary objective of the present invention is to provide a modularized compound receptacle structure of an external power supply unit by utilizing a modularized seat body to make the proper assembly of several conducting strips of the power supply unit and to enable the insert construction composed by the conducting strips thereof to have multidirectional options, furthermore, to enable the lapped disposition of the switch components, the power indicator lights or the protective cover elements to coordinate multi-dimensionally and to efficiently reduce the volume of the power supply unit; the basic formation is programmed as below:

The structure adapts a seat body provided for forming an assembly of three sets of the conducting strips for plugging the conductors, wherein, the said seat body comprises at least more than two sets of receiving slots and a lapping body situated outside the receiving slots; the first conducting strip of the three sets of conducting strips is a strip body in a length capable of transversely crossing every receiving slot and disposed on the lapping body outside of the receiving slot for positioning; the second conducting strip is an independent strip body with equivalent number of receiving slots, every strip body has an insert portion to be mounted in every receiving slot, the said second conducting strip has an extending contact end; furthermore, the third conducting strip is a strip body in a length capable of transversely crossing every receiving slot, an insert portion corresponding to every receiving slot is formed on the strip body, thereby, every set of the receiving slots of the seat body respectively accommodates the respective insert portions of the second and the third conducting strips so as to form an area for inserting the plugs, furthermore, by utilizing the fact that the extending contact ends of the second conducting strip in every receiving slot are adjacent to but do not contact the first conducting strip thereby defining an area between the said every contact end and the first conducting strip for providing the spontaneous contact of the additionally disposed conducting members thus to form a switch area for turning the circuit on or off and for fitting with switch components in various types to link the said conducting member; furthermore, the said second and the third conducting strips connect respectively with two contact feet in proper length of the power indicator lights permitting the power indicator lights to be mounted at any desired location.

Another objective of the present invention is to provide a modularized compound receptacle structure of an external power supply unit by using a seat cover designed correspondingly to the mentioned receiving slot of the seat body for covering the seat body; the cover plane thereof corresponds to the positions of the respective insert portions which are on the second and the third conducting strips inside the mentioned every set of receiving slots and disposed with plug holes or open space for the insert feet of the plugs to go through; furthermore, the top plane of the seat cover and the lateral plane of the mentioned seat body can be molded into proper flange body construction for assembling the protective cover and for properly situate the protective cover between the receptacle seat shell member and the mentioned seat body to form a safe protective cover structure.

To enable a further understanding of the primary features and technical contents of the present invention, the brief description of the drawings below is followed by the detailed description of several exemplary and preferred embodiments.

DETAILED DESCRIPTION OF THE PREFERRED EMBODIMENTS

Figure 1:
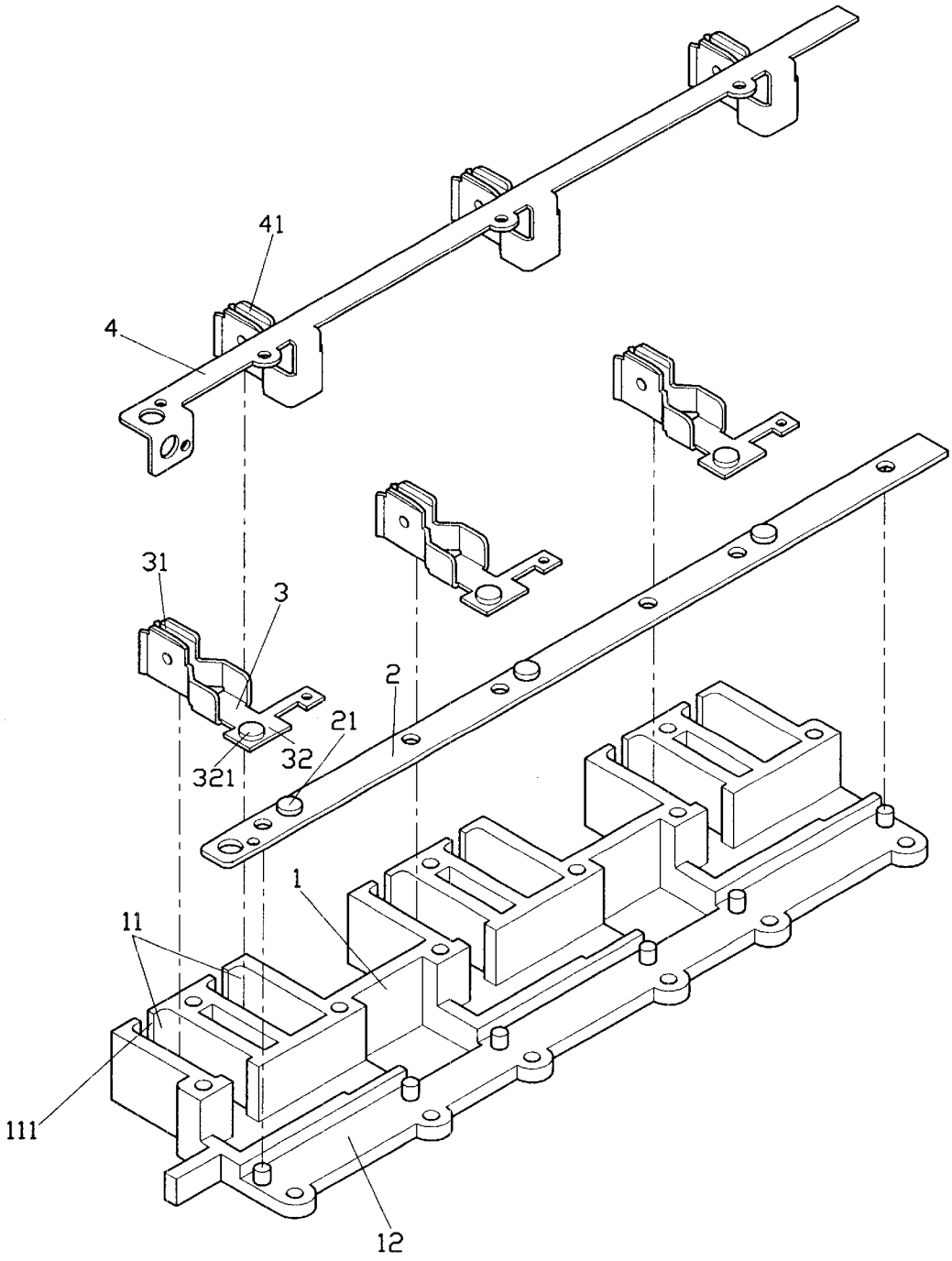
FIG. 1 is a schematic drawing of the structure of the primary module components of the present invention.

Referring to FIG. 1 of the modularized compound receptacle, the innovative structural components mainly adapt a seat body (1) provided for forming and positioning an assembly of three sets of conducting strips for the power supply unit to plug in the conductors, the three sets of conducting strips are distinguished as the first conducting strip (2), the second conducting strip (3) and the third conducting strip (4), wherein, the said seat body (1) comprises at least more than two sets of receiving slots (11), two sections are disposed in the receiving slot (11), one lateral plane of every set of receiving slot (11) corresponds to the positions of the respective insert portions (31, 41) which are on the second (3) and the third (4) conducting strips to be mentioned hereafter and disposed with plug holes (111) (or an open space) for the insert feet of the plugs to go through; the outer portion on the other side of the seat body (1) relative to the receiving slot (11) is extended and molded as a lapping body (12).

The said first conducting strip (2) is a long strip body in a length capable of transversely crossing every set of receiving slots (11) of the seat body (1) and is disposed on the lapping body (12) outside of the receiving slot (11) of the seat body (1) for positioning.

The said second conducting strip (3) is an independent strip body with equivalent number of the mentioned receiving slots (11), every strip body is molded with an insert portion (31) to be mounted inside one of the sections in the receiving slot (11) of the seat body (1), the insert portion (31) has multiple plug-in holes in different directions, furthermore, the second conducting strip (3) extends to form a contact end (32); the contact points (321, 21) can be disposed at the corresponding area between the said contact end (32) and the strip body of the mentioned first conducting strip (2) for contacting the conducting member (8) to be mentioned hereafter.

The third conducting strip (4) is a strip body in a length capable of transversely crossing every mentioned set of receiving slots, an insert portion (41) is defined in the other section where the strip body corresponds to every set of receiving slots (11), the insert portion (41) has multiple plug-in holes in different directions.

Figure 2:
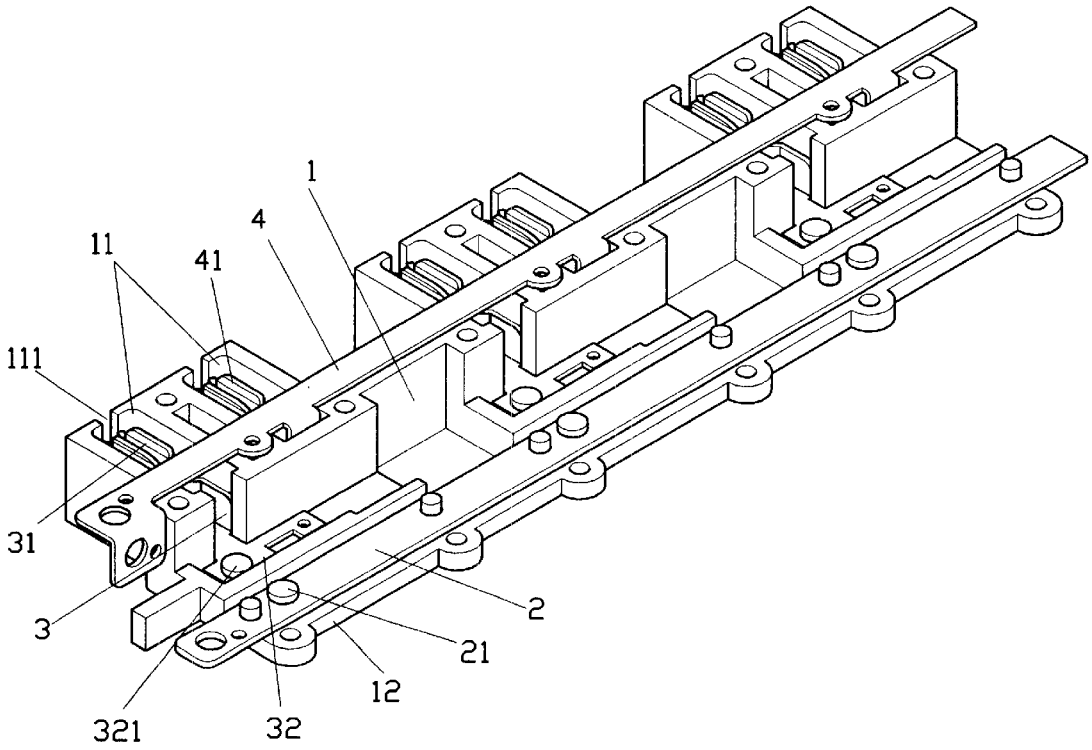
FIG. 2 is a schematic drawing of the assembled primary module components of the present invention.

Through the assembly of the mentioned primary components, as shown in FIG. 2, the two sections inside every set or receiving slots (11) of the seat body (1) provide the respective accommodation for the insert portion (31) of the second conducting strip (3) and the insert portion (41) of the third conducting strip (4) and form an area for inserting the plugs; furthermore, under this assembled state, the contact ends (32) extended from the second conducting strip (3) in every set of receiving slots are adjacent to but do not contact the first conducting strip (2); by virtue of this design, a receptacle base module equipped with switch contact points is formed with options of installing multiple subsidiary elements; the related alternative embodiments are described in the following sections.

Figure 3:
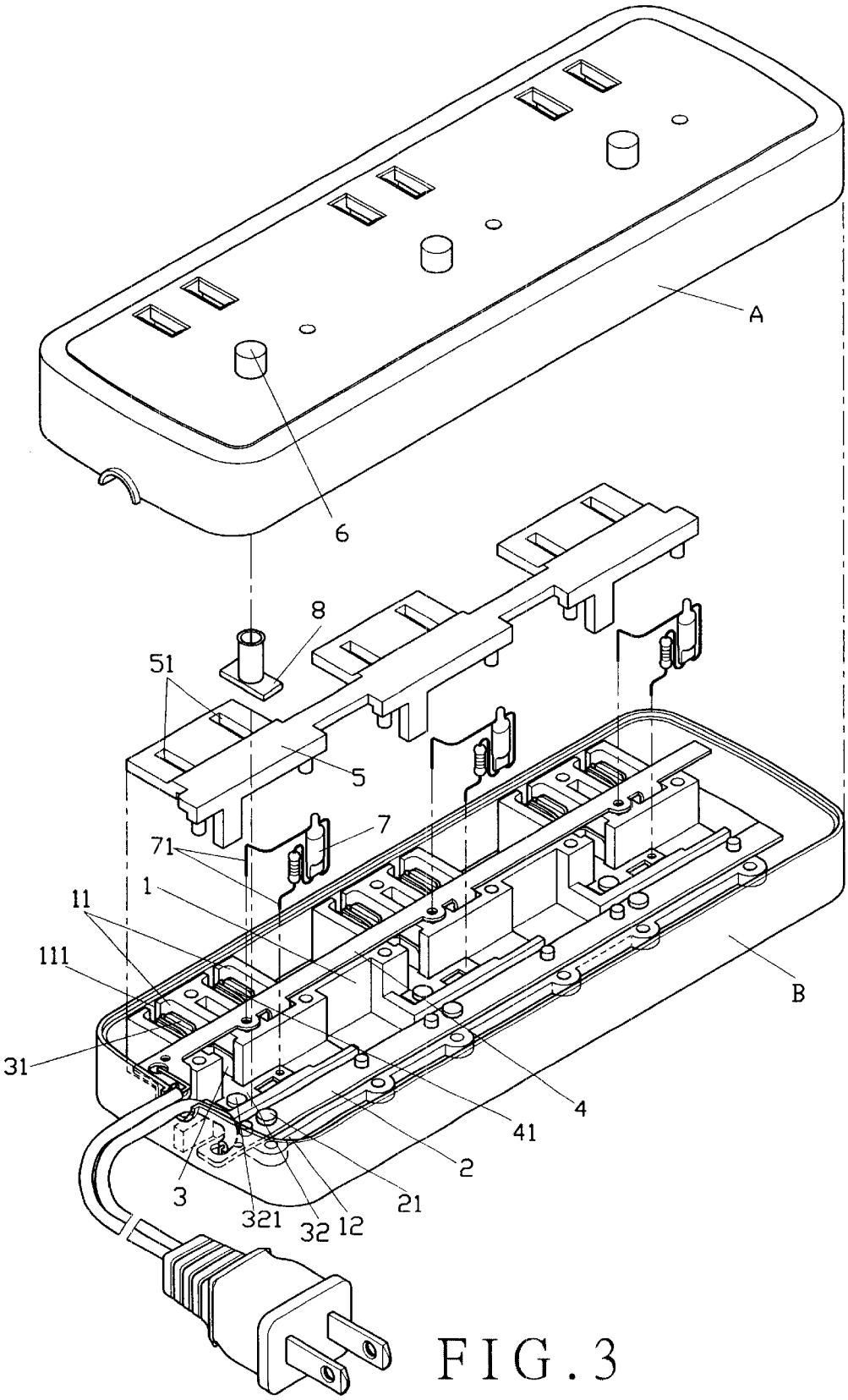
FIG. 3 is a schematic drawing of the receptacle assembled by the primary module components coordinated with the subsidiary elements of the present invention.

First, when the mentioned base module to be assembled with the other subsidiary elements to compose a seated extension cord switch receptacle, a seat cover (5) is disposed with the matching switch components (6) (a schematic formation shown in the said FIG. 3), power indicator lights (7), the upper and lower shell members (A, B) of the receptacle, as shown in FIG. 3, the seat cover (5) is disposed correspondingly to the receiving slot (11) of the mentioned seat body (1) for covering on the seat body (5); the cover plane corresponds to the positions of the respective insert portions (31, 41) which are on the second (3) and the third (4) conducting strips in every set of receiving slots (11), disposed with plugholes (51) (or an open space); furthermore, between every contact end (32) extended from the mentioned second conducting strip (3) and the first conducting strip (2), a conducting member (8) is mounted correspondingly to form an area for spontaneous contacting of the conducting members (8) for providing a switch area to turn on or off the circuit; the conducting members (8) coordinate with the switch components (6) for mutual link, the said switch components (6) can be designed into various types; in addition, the power indicator light (7) use the two contact feet (71) in proper length thereof to conjoin the second conducting strip (3) and the third conducting strip (4) to lighten up the circuit during the conducting; the said power indicator light (7) is not assembled to a fixed location according to a determined pattern, it can fit with the proper construction of the seat cover (5) or on the upper and lower shell members (A, B) of the receptacle and be inserted at any desired location; it is only necessary to use the extending contact feet (71) to connect with the second conducting strip (3) and the third conducting strip (4) to get the flexibility of alternating multiple positional assemblies and dispositions; furthermore, the seat body (1) can be unitarily molded inside the lower shell member (B) of the receptacle and the seat cover (5) can also be unitarily molded on the inner bottom plane of the upper shell member (A) of the receptacle.

Figure 4:
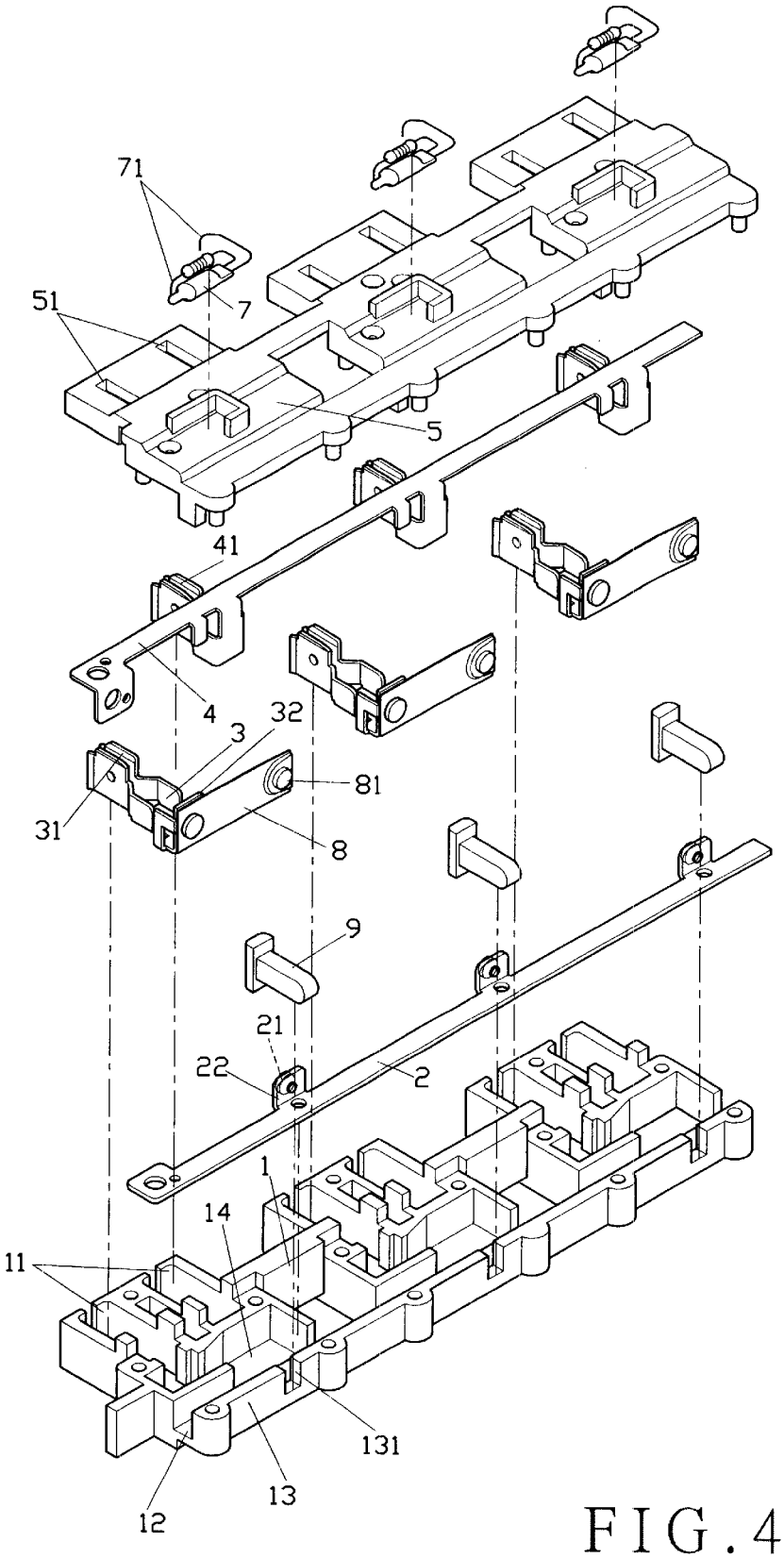
FIG. 4 is a schematic drawing of another embodiment structure of the receptacle assembled by the primary module components coordinated with the subsidiary elements of the present invention.
Figure 5:
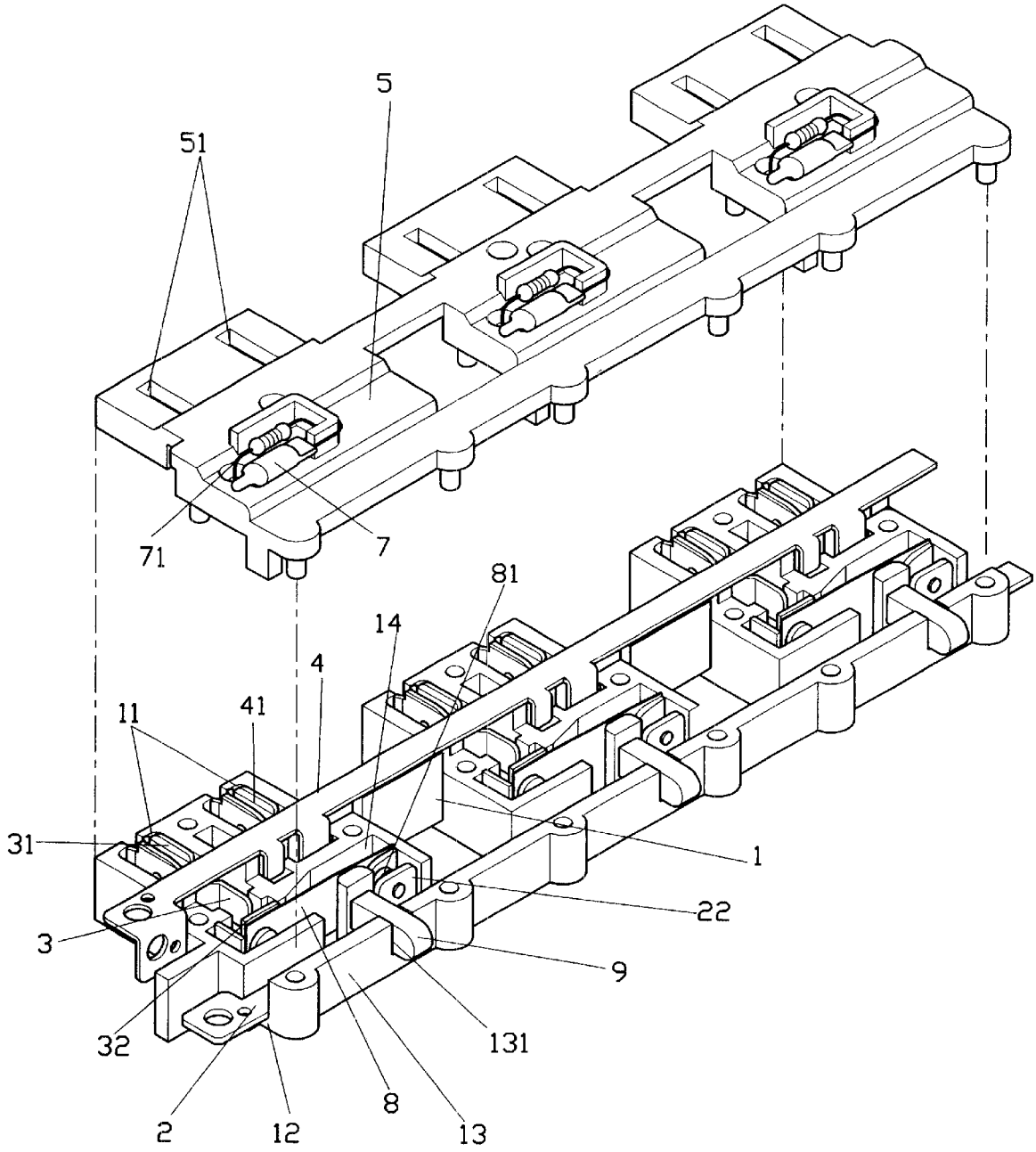
FIG. 5 is a schematic drawing of another partially assembled embodiment structure of the receptacle assembled by the primary module components coordinated with the subsidiary elements of the present invention.

The shapes of the mentioned seat body (1) and the seat cover (5) can be properly changed, as shown in the following figures; they can be designed to enclose the first conducting strip (2), the second conducting strip (3) and the third conducting strip (4) to form a sealed box body in assembled state, wherein, as shown in FIG. 4, the outer edge of the lapping body (12) of the seat body (1) is formed as a block flange (13) with the notches (131) thereon; a slot section (14) is molded between the lapping body (12) and the receiving slot (11) to make the power indicator light (7) be disposed on the top plane of the seat cover (5) and make the contact feet (71) thereof go through the cover body and extend to the lower extent; furthermore, the shapes of the first conducting strip (2) and the second conducting strip (3) can be alternated to make the first conducting strip (2) have the extending contact ends (22) with contact points (21) thereby to make the contact ends (22) of the first conducting strip (2) and the contact ends (32) of the second conducting strip (3) to stagger and correspond to each other; the contact ends (22, 32) are disposed pendulously; furthermore, the contact end (32) of the second conducting strip (3) couple the conducting member (8); the other end of the conducting member (8) has contact point (81) relative to the contact point (21) of the contact end (22) of the first conducting strip (2) to be mounted into a state of normal contact; additionally, the said conducting member (8) can be disposed to conjoin the contact end (22) of the first conducting strip (2), or the conducting member (8) can be disposed into a state for making complete movement and oriented reciprocating shift for providing spontaneous contact or separating from the two contact ends (22, 23) (not shown in FIGS. 3 and 4); a link member (9) is mounted to press against the said conducting member (8) for driving; thereby, as shown in FIG. 5, the conducting components are approximately disposed inside the seat body (1) according to the mentioned formation, wherein, the conducting member (8) is installed in the slot section between the lapping body (12) and the receiving slot (1 1) to make the contact end (22) of the first conducting strip (2) and the contact end (32) of the second conducting strip (3) correspond to the two ends of the conducting member (8); the link member (9) is inserted in the notch (131) on the block flange (13) at the outer edge of the lapping body (12) to make the inner end thereof press and connect with the conducting member (8) while the outer end thereof protrudes outward in a small section, then the seat cover (5) with power indicator light (7) on the top plane is used to cover; the power indicator light (7) can be penetrated through the contact feet (71) of the seat cover (5) first to conjoin the second conducting strip (3) and the third conducting strip (4) thereby to gain another kind of base module with power indicator light (7) and switch function for interrupting or conducting the power.

By utilizing the mentioned another kind of base module with more functions, the switch components (6) used for fitting to drive the said link member (9) to move inward to link the conducting member (8) for controlling the interruption or conducting of the power can be designed into relatively many designing alternations which will be illustrated respectively as follows; furthermore, in the following Figures, a transparent casing (72) mounted on the upper shell member (A) of the receptacle is disclosed; this transparent casing (72) corresponds to the power indicator light (7) on the seat cover (5), the brightness of the power indicator light (7) can be viewed on the outer portion.

Figure 6:
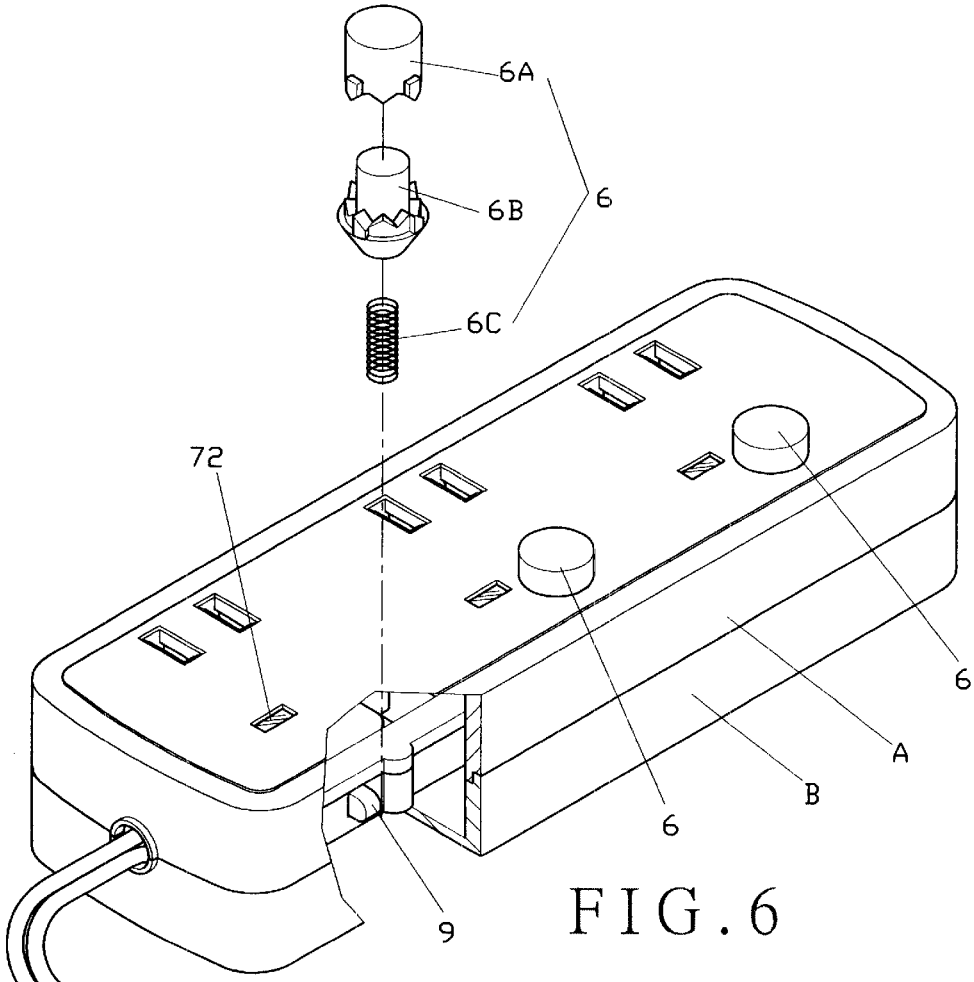
FIG. 6 is a schematic drawing of the base module matched with the switch components (1) of the present invention.
Figure 7:
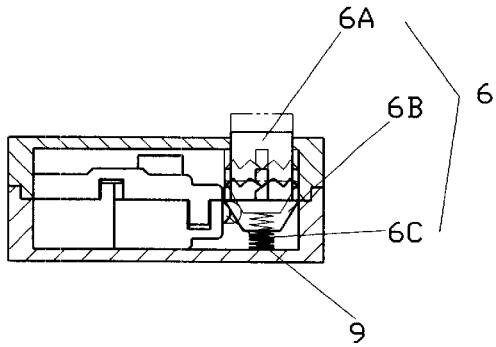
FIG. 7 is an implementation drawing of the base module matched with the switch components (1) of the present invention.

A. As shown in FIGS. 6 and 7, the said switch component (6) employs the general press-button design of depressing to position and depressing again for elastically raising up, that comprises an outer and an inner button bodies (6A, 6B) and an elastic element (6C), the button is disposed on the top plane of the receptacle and pushes the link member (9) to project the outer end thereof by means of the inner button body (6B).

Figure 8:
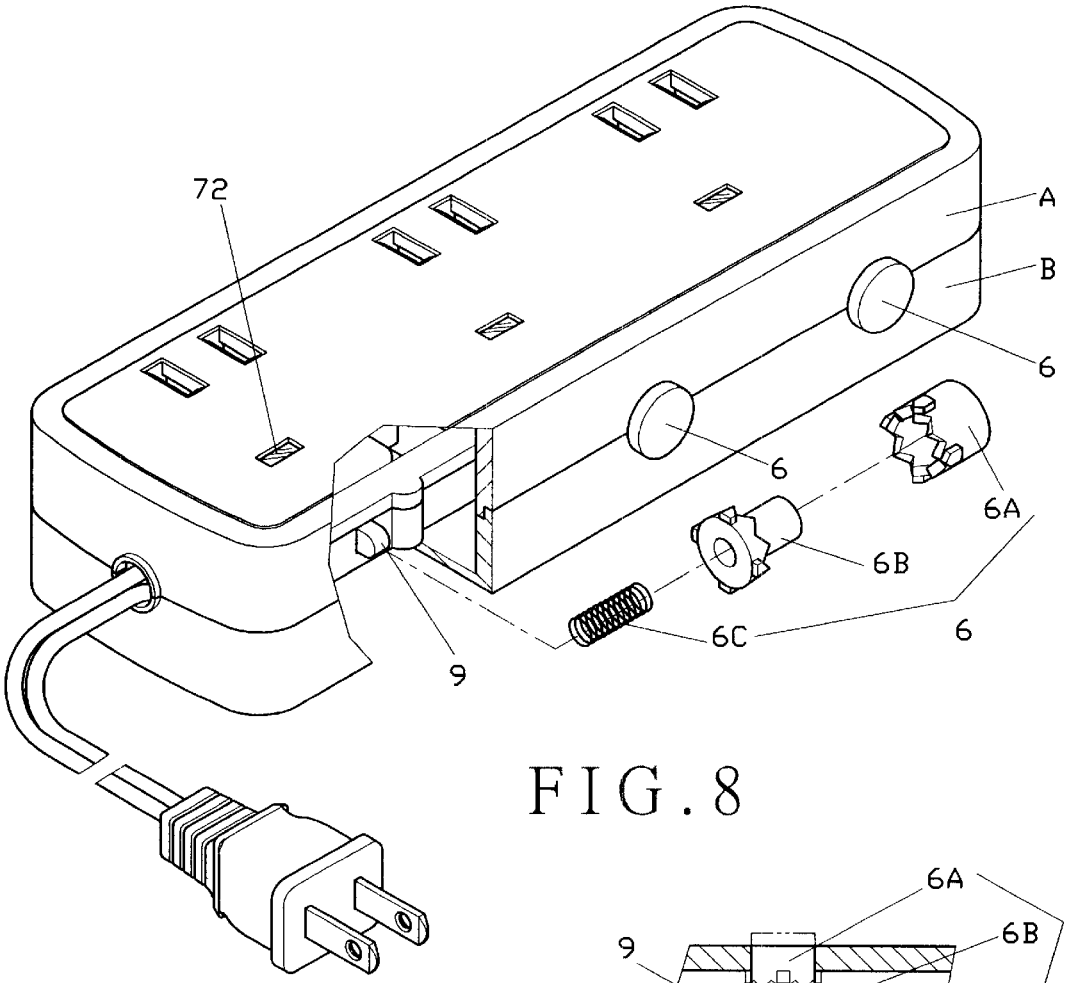
FIG. 8 is a schematic drawing of the base module matched with the switch components (2) of the present invention.
Figure 9:
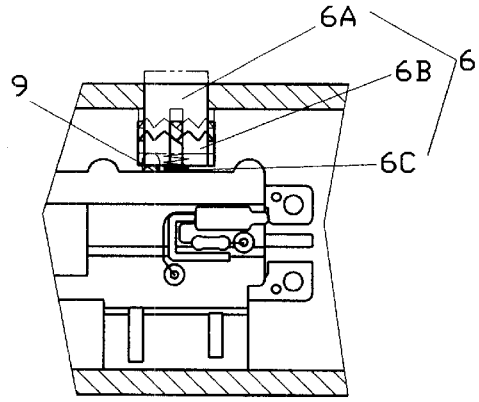
FIG. 9 is an implementation drawing of the base module matched with the switch components (2) of the present invention.

B. As shown in FIG. 8 and 9, the said switch component (6) is also a press-button design comprising of an inner and an outer button bodies (6A, 6B) and an elastic element (6C), however, it is disposed on the lateral plane of the receptacle.

Figure 10:
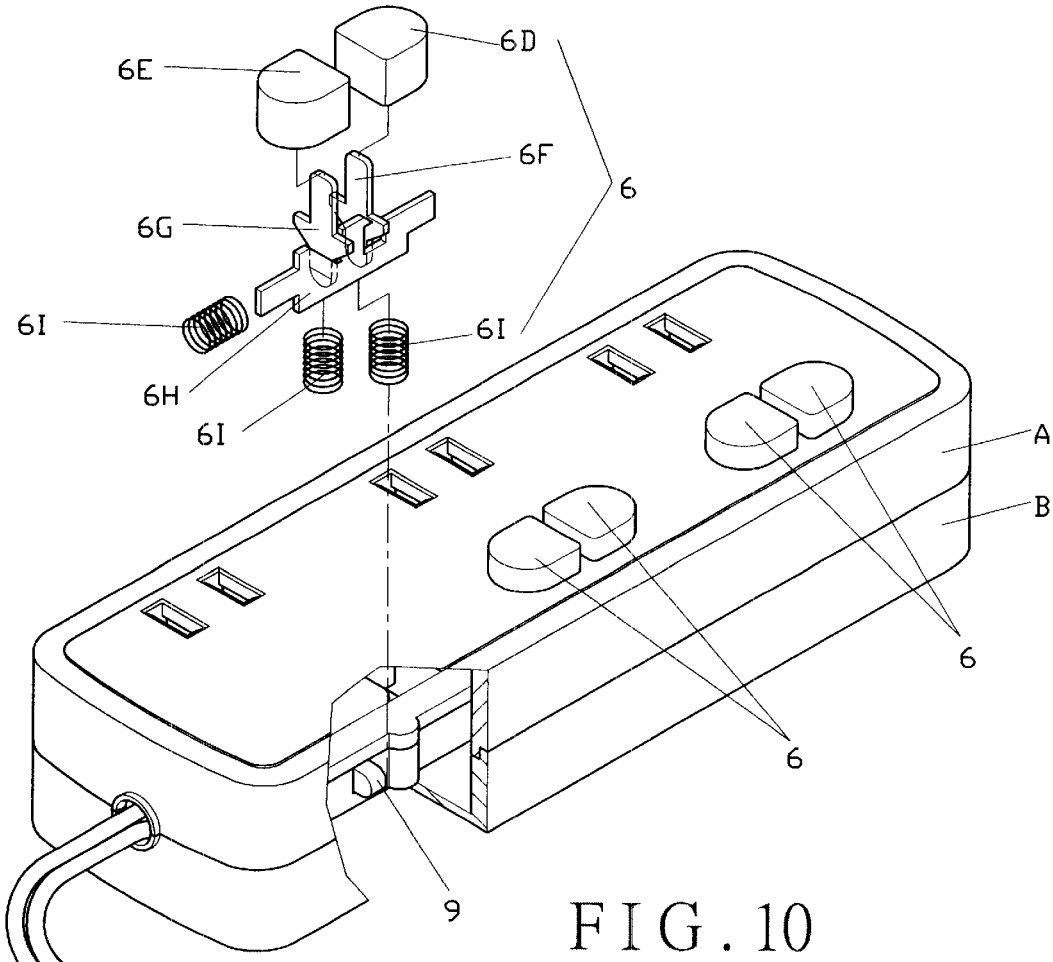
FIG. 10 is a schematic drawing of the base module matched with the switch components (3) of the present invention.
Figure 11:
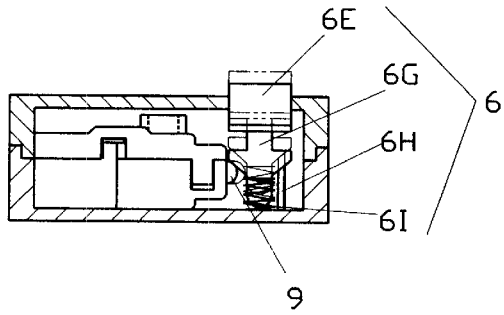
FIG. 11 is an implementation drawing of the base module matched with the switch components (3) of the present invention.

C. As shown in FIGS. 10 and 11, the said switch component (6) is a design of double press-buttons wherein one of the button member controls the elastic raise of another button member after being depressed, that comprises two button bodies (6D, 6E), two push-against pieces (6F, 6G), one positioning plate (6H) and several elastic elements (61); the double press buttons are disposed on the top plane of the receptacle, however, they can also be mounted on the lateral plane of the receptacle and push the link member (9) to project the outer end thereof by means of one of the push-against piece (6F).

Figure 12:
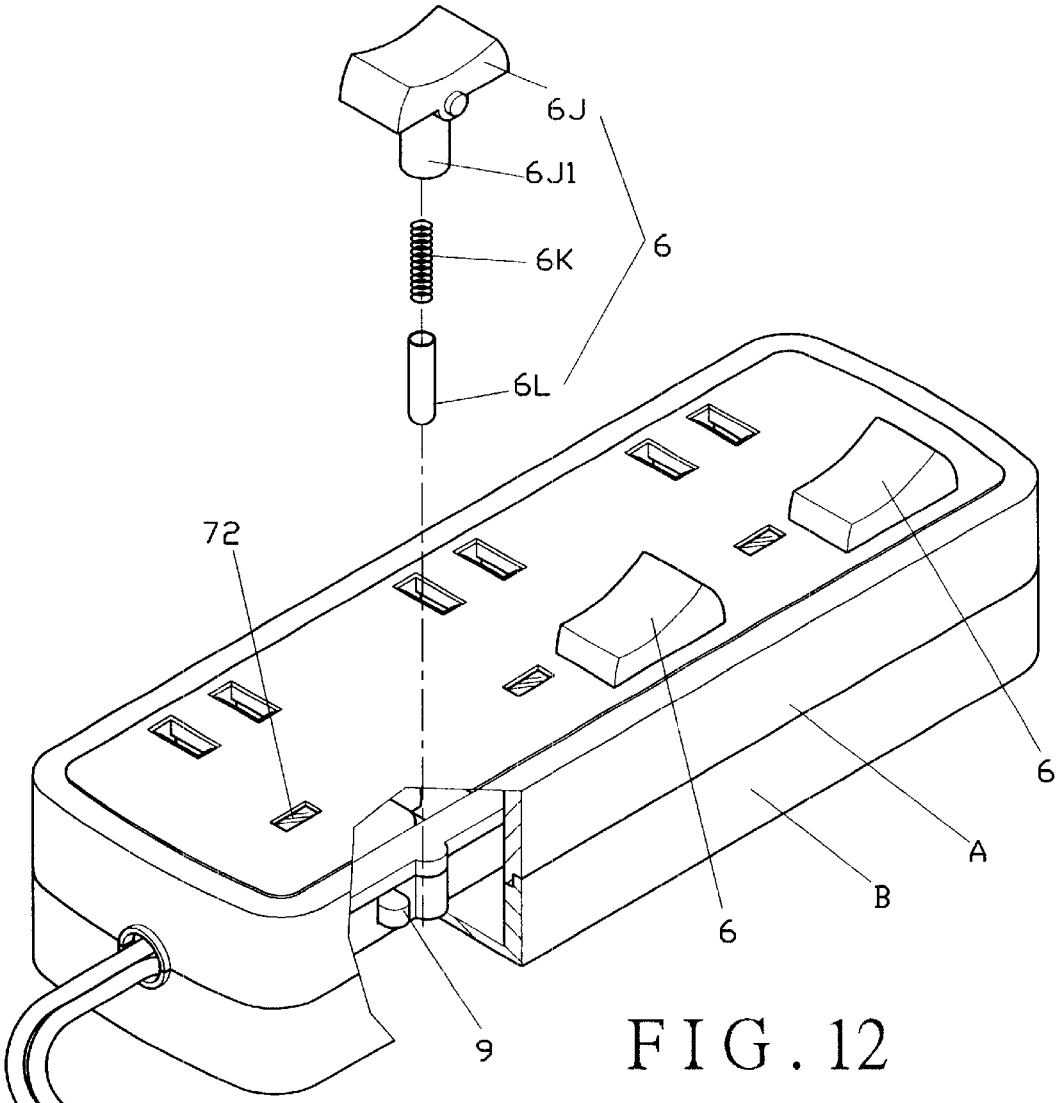
FIG. 12 is a schematic drawing of the base module matched with the switch components (4) of the present invention.
Figure 13:
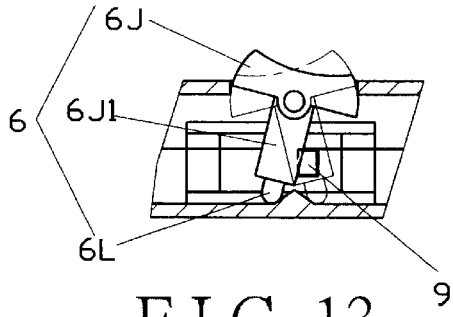
FIG. 13 is an implementation drawing of the base module matched with the switch components (4) of the present invention.

D. As shown in FIGS. 12 and 13, the component (6) is a seesaw-type press-button that comprises a button body (6J), an elastic element (6K) and a pin tube (6L); the button body is disposed on the top plane of the receptacle and pushes the link member (9) to project the outer end thereof by means of the columnar tube (6J 1) beneath the button body (6J).

Figure 14:
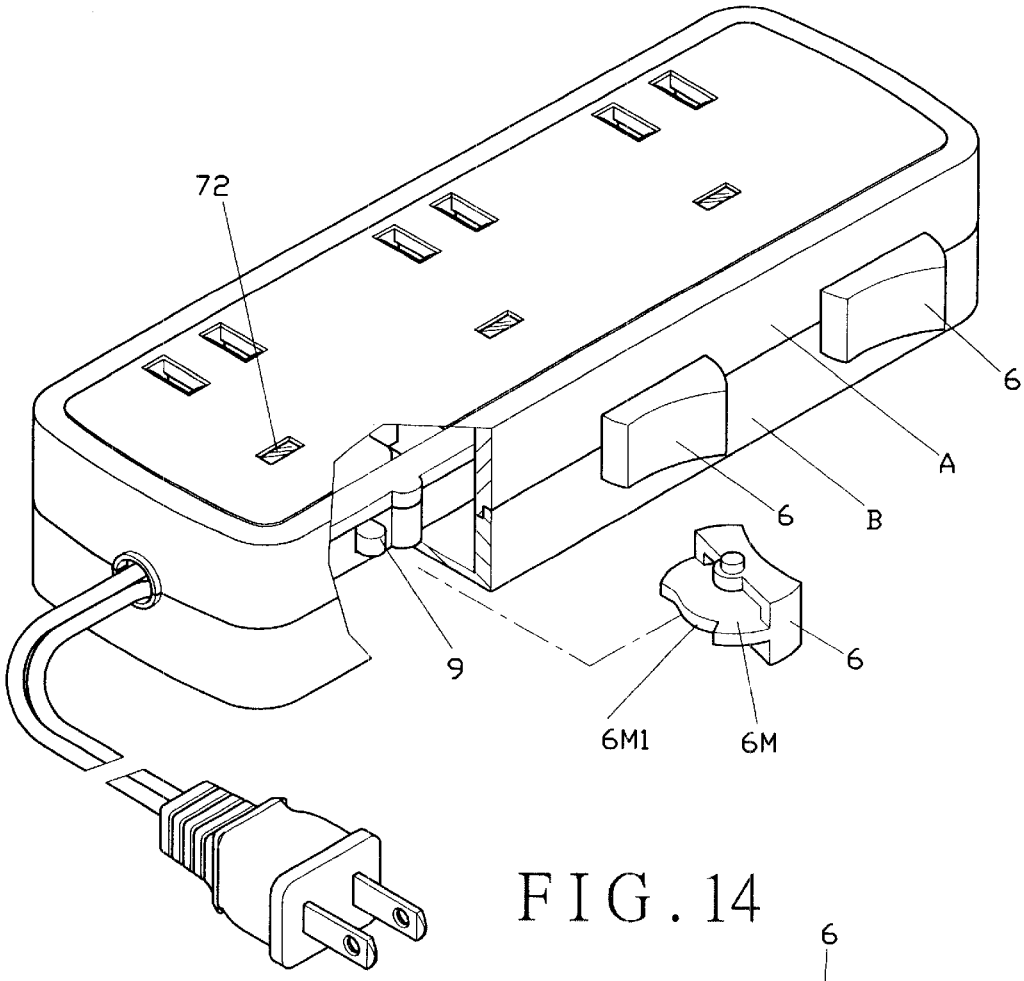
FIG. 14 is a schematic drawing of the base module matched with the switch components (5) of the present invention.
Figure 15:
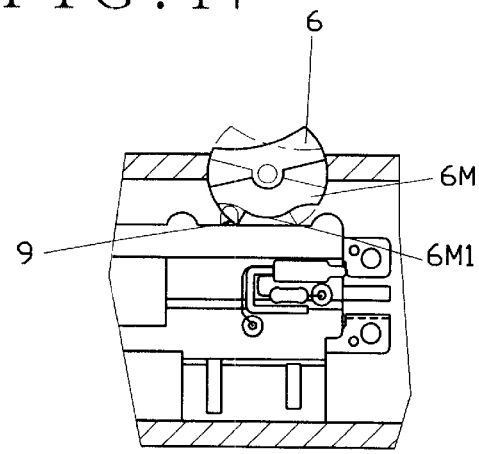
FIG. 15 is an implementation drawing of the base module matched with the switch components (5) of the present invention.

E. As shown in FIGS. 14 and 15, the said component (6) is a seesaw-type press-button disposed on the lateral plane of the receptacle, the bottom plane of the button body is molded into a retaining piece (6M) with a bottom side having an arcuate concaved edge (6M1), it pushes against the link member (9) to project the outer end thereof by means of the relative arcuate concaved edge (6M1).

Figure 16:
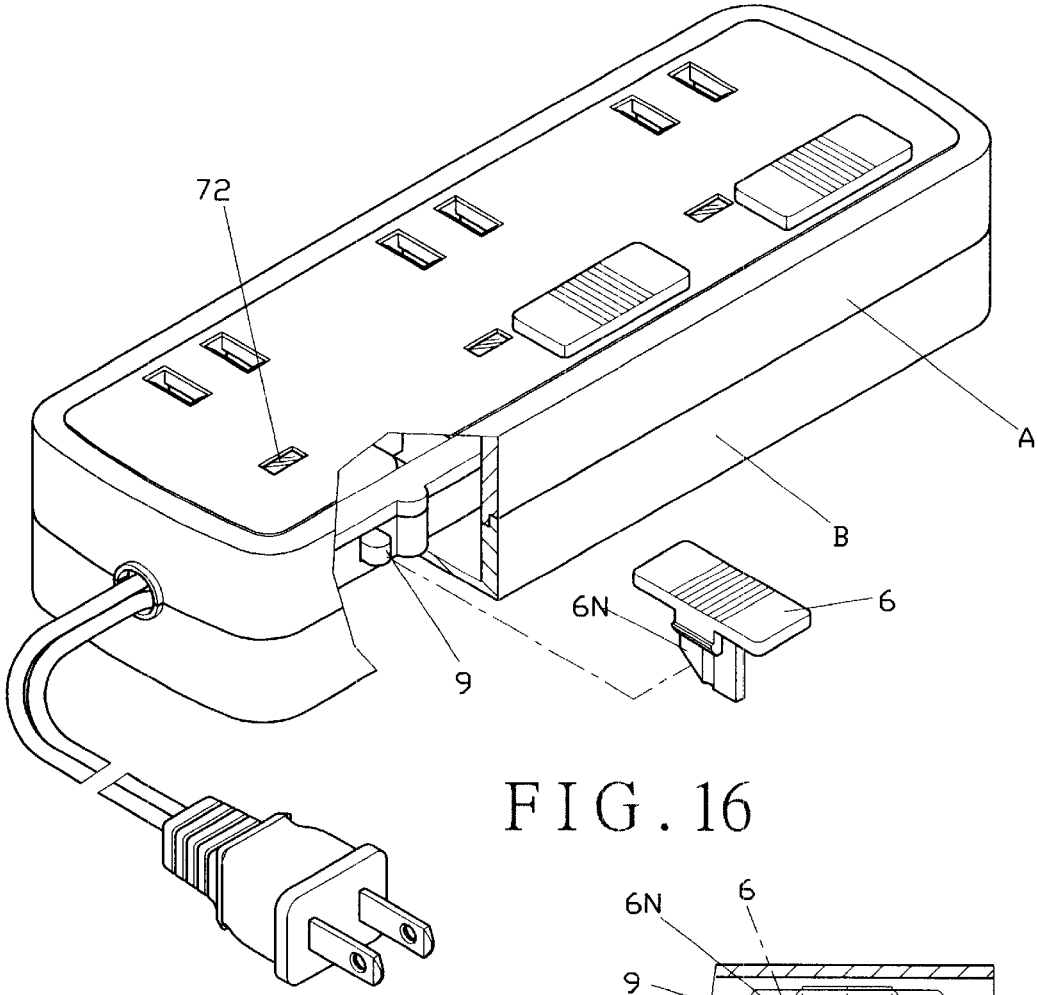
FIG. 16 is a schematic drawing of the base module matched with the switch components (6) of the present invention.
Figure 17:
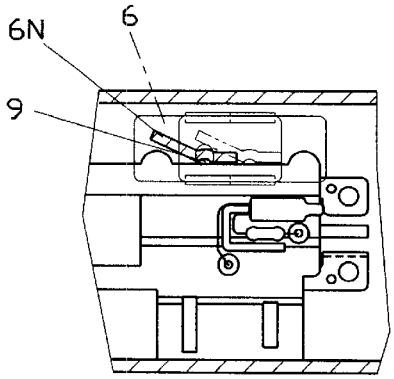
FIG. 17 is an implementation drawing of the base module matched with the switch components (6) of the present invention.
Figure 18:
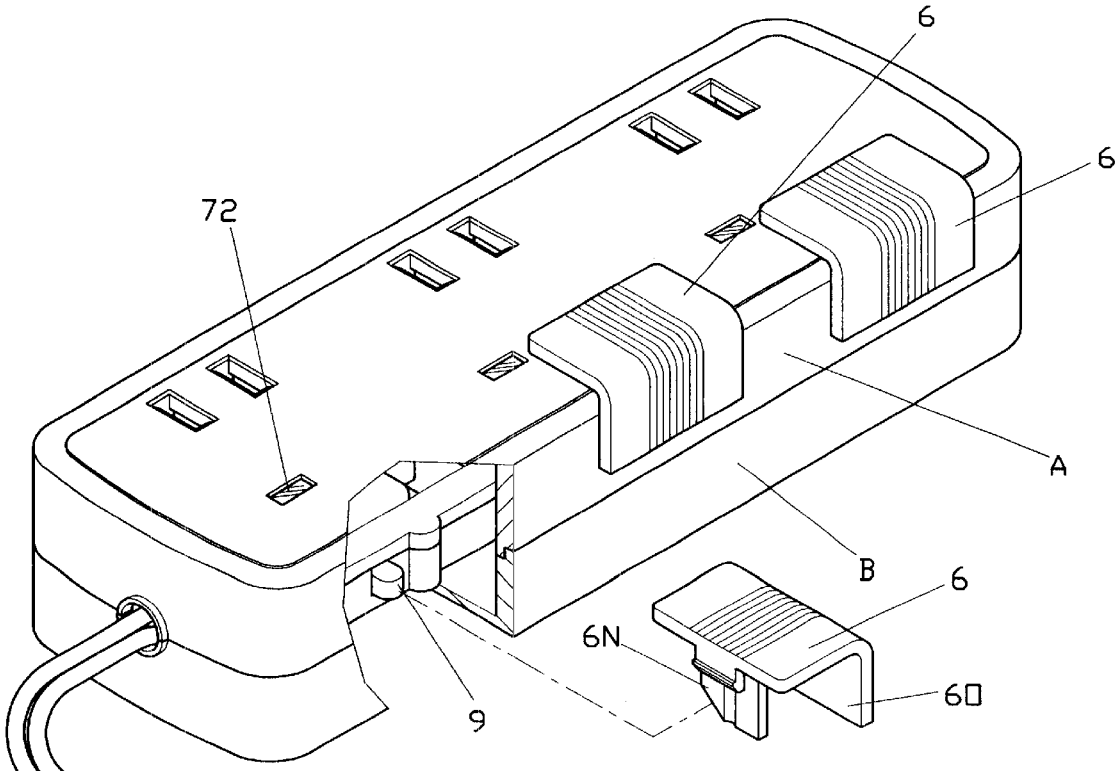
FIG. 18 is a schematic drawing of the base module matched with the switch components (7) of the present invention.
Figure 19:
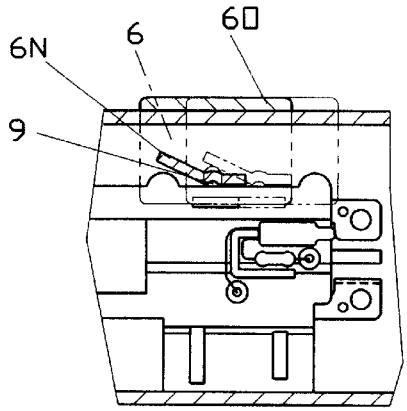
FIG. 19 is an implementation drawing of the base module matched with the switch components (7) of the present invention.

F. As shown in FIGS. 16 and 17, the said component (6) is a transversely moving push-button disposed on the top plane of the receptacle, an inclined plate (6N) is molded beneath the button body and pushes against the link member (9) to project the outer end thereof G. As shown in FIGS. 18 and 19, the said component (6) is also a transversely moving push-button with an additional push plane (6O) extending to the lateral side to form a double push-button, an inclined plate (6N) is also molded beneath the button body and pushes against the link member (9) to project the outer end thereof.

Figure 20:
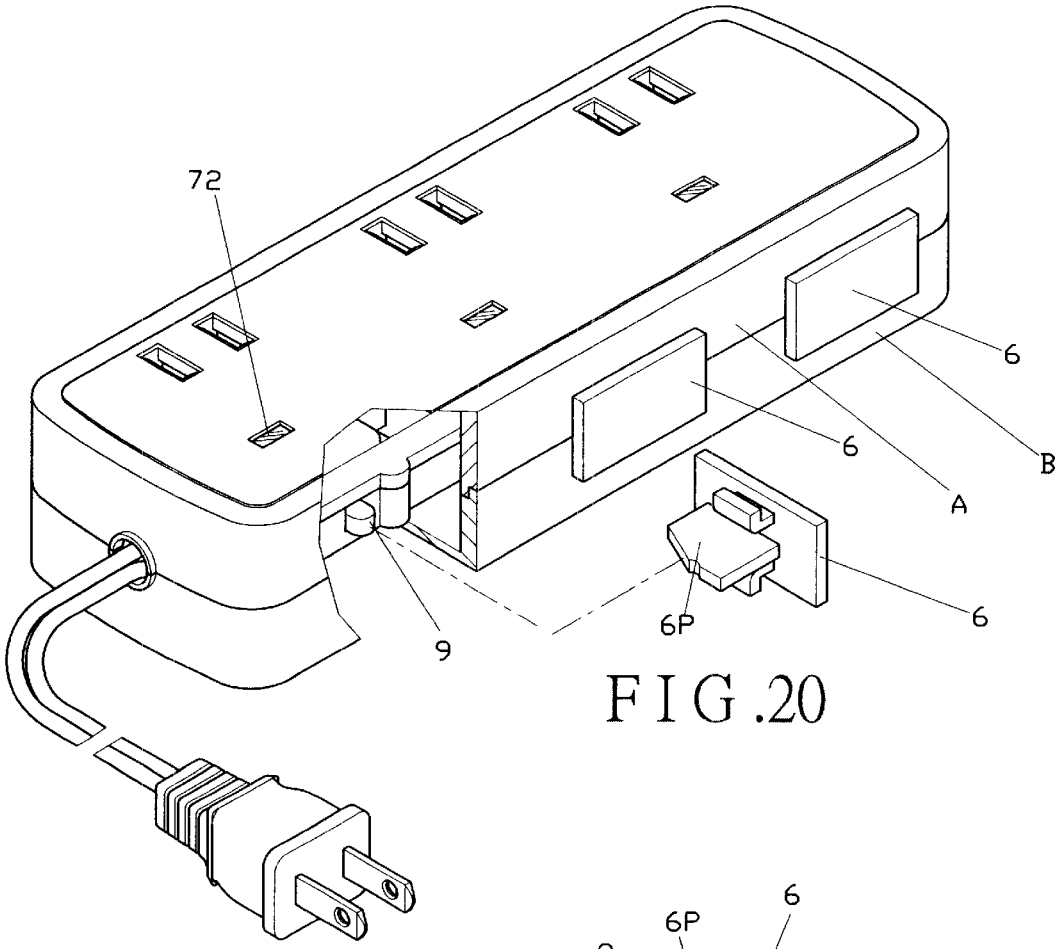
FIG. 20 is a schematic drawing of the base module matched with the switch components (8) of the present invention.
Figure 21:
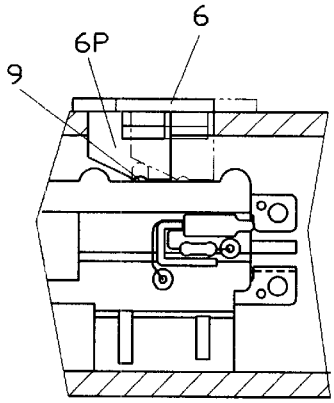
FIG. 21 is an implementation drawing of the base module matched with the switch components (8) of the present invention.

H. As shown in FIGS. 20 and 21, the said component (6) is a transversely moving push-button disposed on the lateral plane of the receptacle with the inner plane of the button body molded as a push plate (6P) and the bottom edge thereof pushes against the link member (9) to project the outer end thereof.

Figure 22:
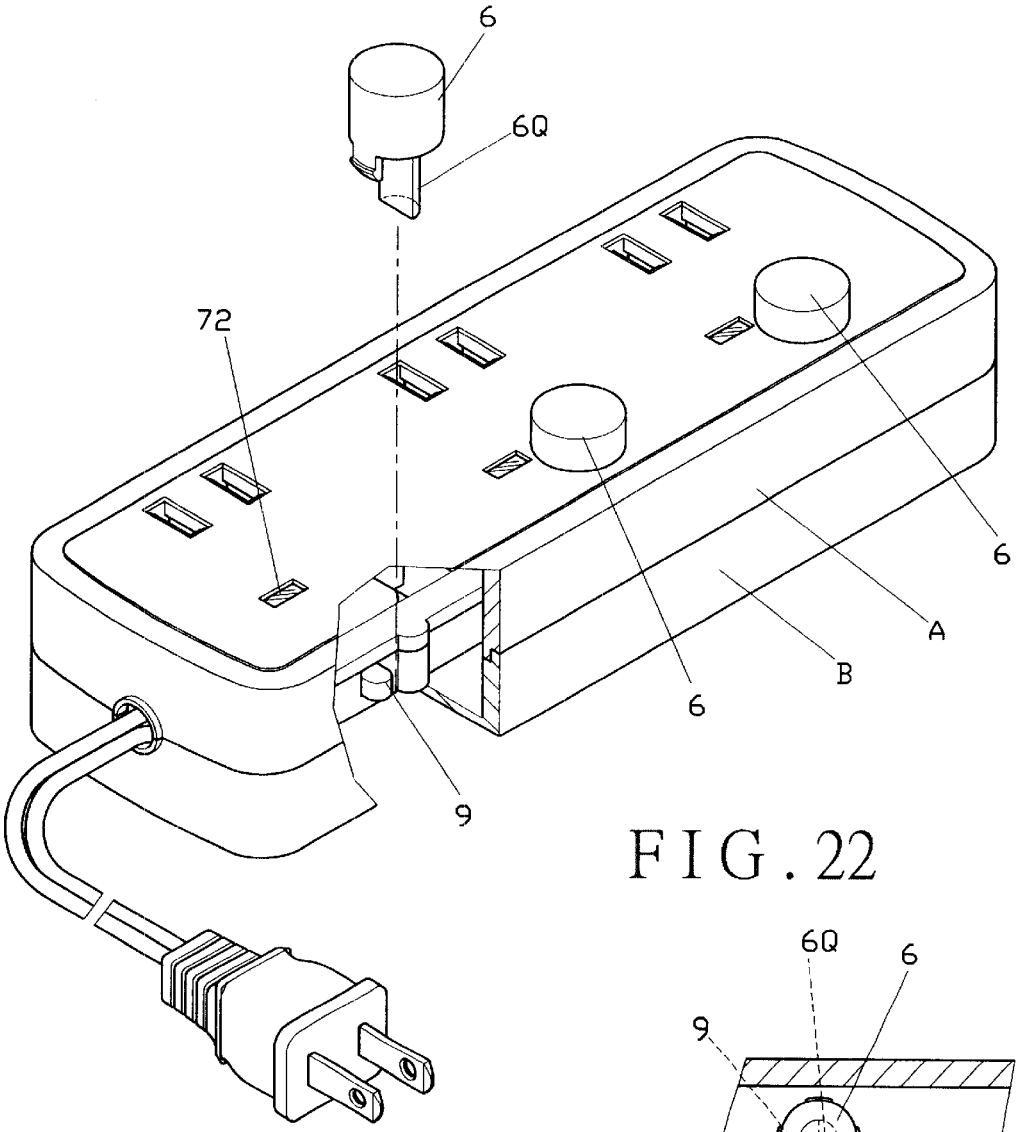
FIG. 22 is a schematic drawing of the base module matched with the switch components (9) of the present invention.
Figure 23:
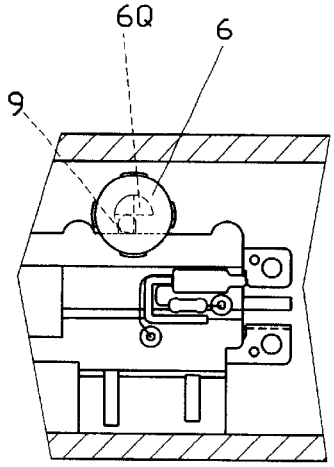
FIG. 23 is an implementation drawing of the base module matched with the switch components (9) of the present invention.

I. As shown in FIGS. 22 and 23, the said component (6) is a rotatory turning-button disposed on the top plane of the receptacle with a semi-circular column (6Q) molded beneath the button body for pushing against the link member (9) to project the outer end thereof.

Figure 24:
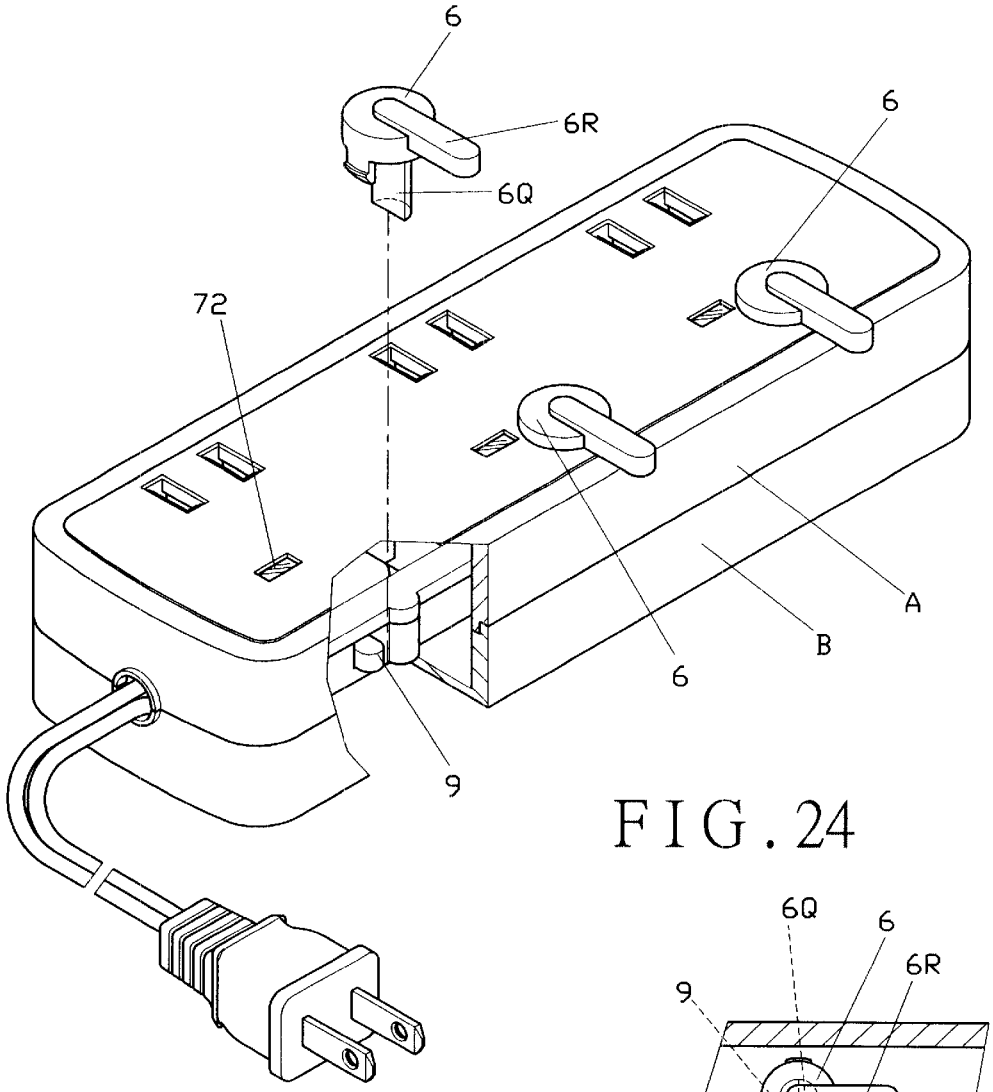
FIG. 24 is a schematic drawing of the base module matched with the switch components (10) of the present invention.
Figure 25:
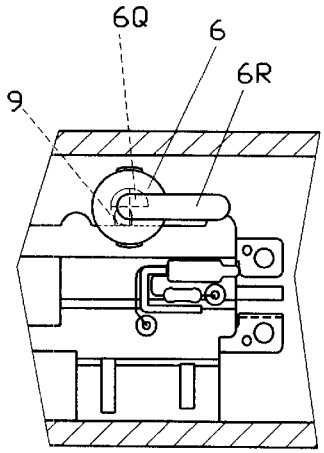
FIG. 25 is an implementation drawing of the base module matched with the switch components (10) of the present invention.
Figure 26:
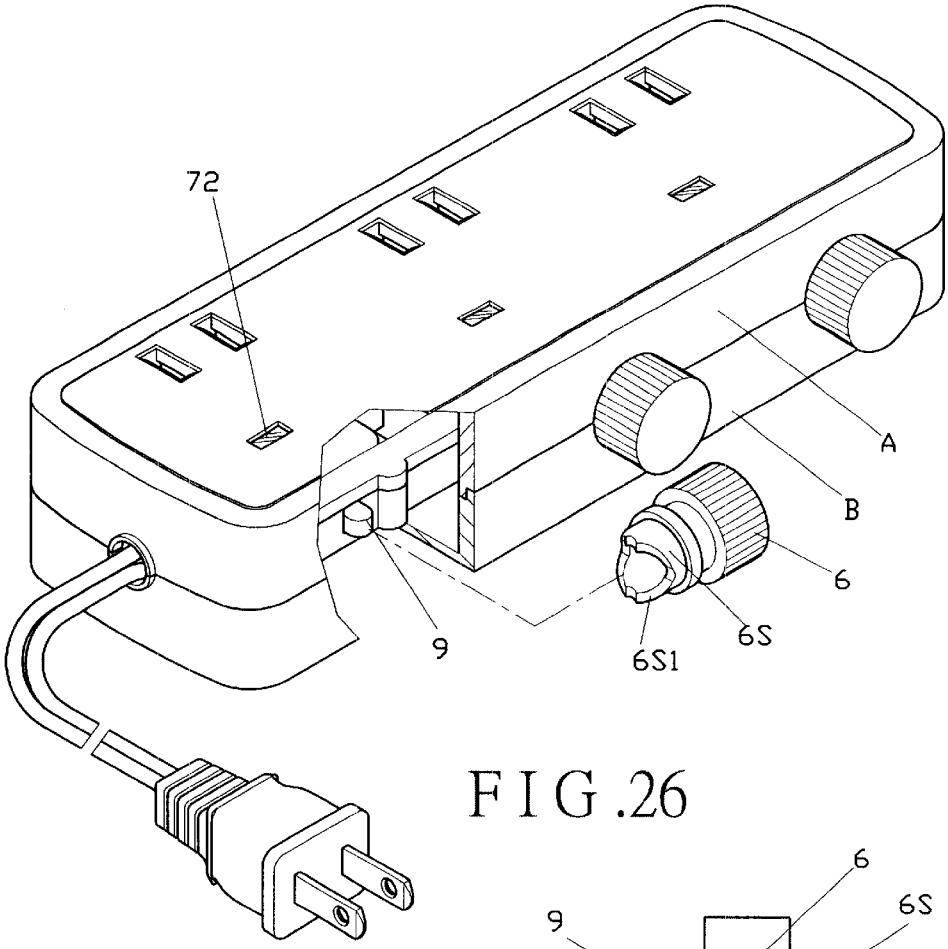
FIG. 26 is a schematic drawing of the base module matched with the switch components (11) of the present invention.
Figure 27:
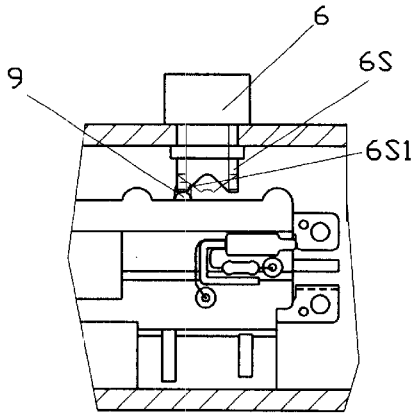
FIG. 27 is an implementation drawing of the base module matched with the switch components (11) of the present invention.

J. As shown in FIGS. 24 and 25, the said component (6) is also a rotatory turning-button disposed on the top plane of the receptacle, however the button body has a push rod (6R) with a semi-circular column (6Q) also molded beneath the button body for pushing against the link member (9) to project the outer end thereof K. As shown in FIGS. 26 and 27, the said component (6) is a rotatory turning-button disposed on the lateral plane of the receptacle, the inner plane of the button body is molded into a hollow tube (6S) and the bottom end of the tube body is formed as multiple arcuate concaved edge (6S1) for pushing against the link member (9) to project the outer end thereof to form continuous turning.

Figure 28:
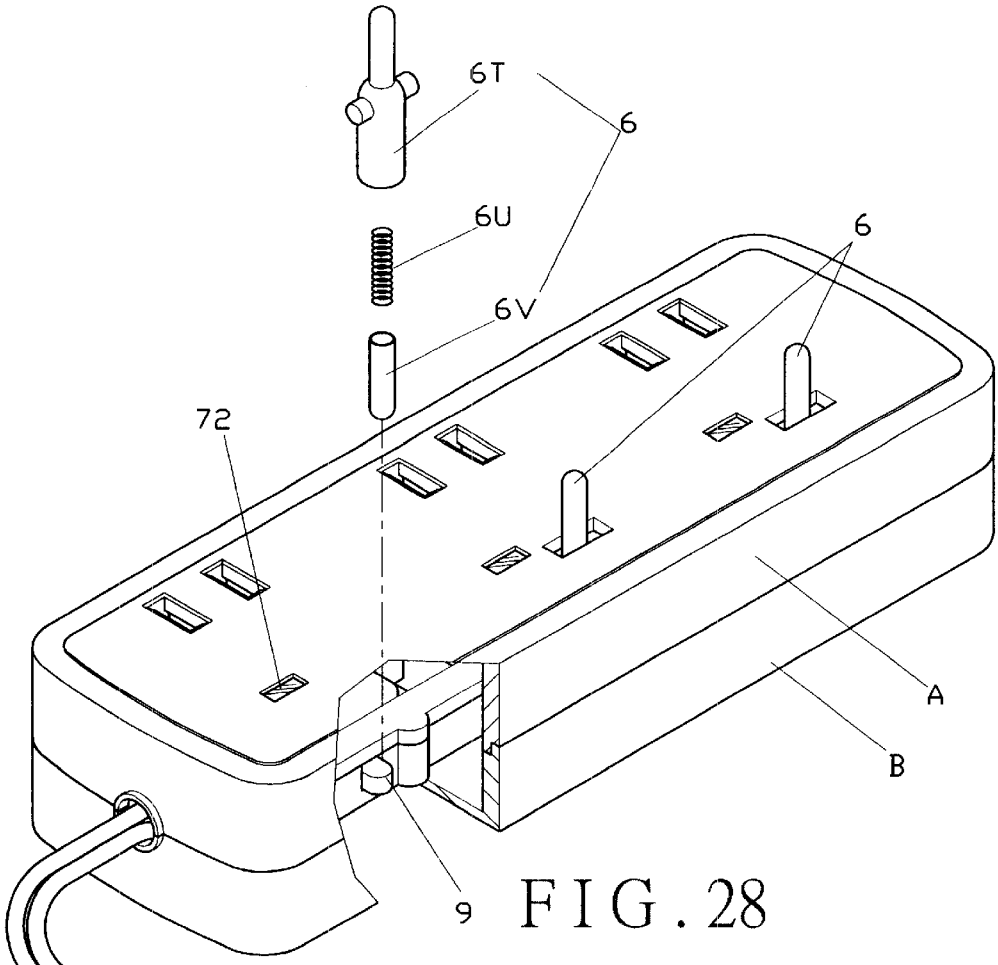
FIG. 28 is a schematic drawing of the base module matched with the switch components (12) of the present invention.
Figure 29:
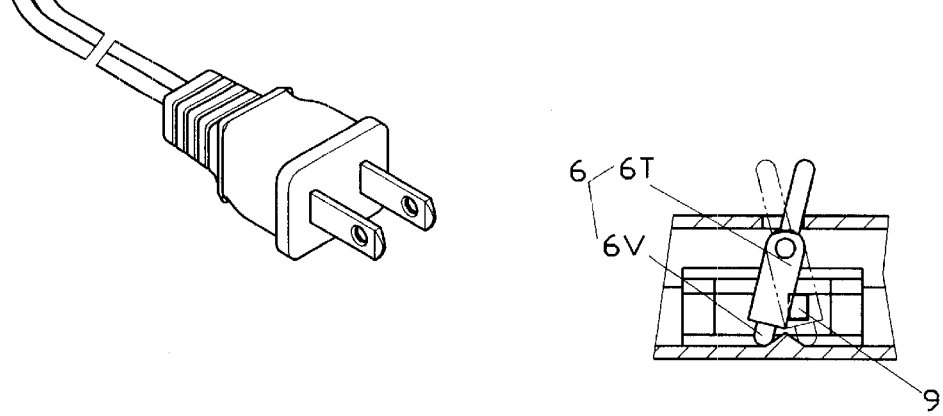
FIG. 29 is an implementation drawing of the base module matched with the switch components (12) of the present invention.

L. As shown in FIGS. 28 and 29, the component (6) is a swing-type rocking bar comprises a bar body (6T), an elastic element (6U) and a pin tube (6V), the rocking bar is disposed on the top plane of the receptacle, the bar body (6T) pushes against the link member (9) to project the outer end thereof.

Figure 30:
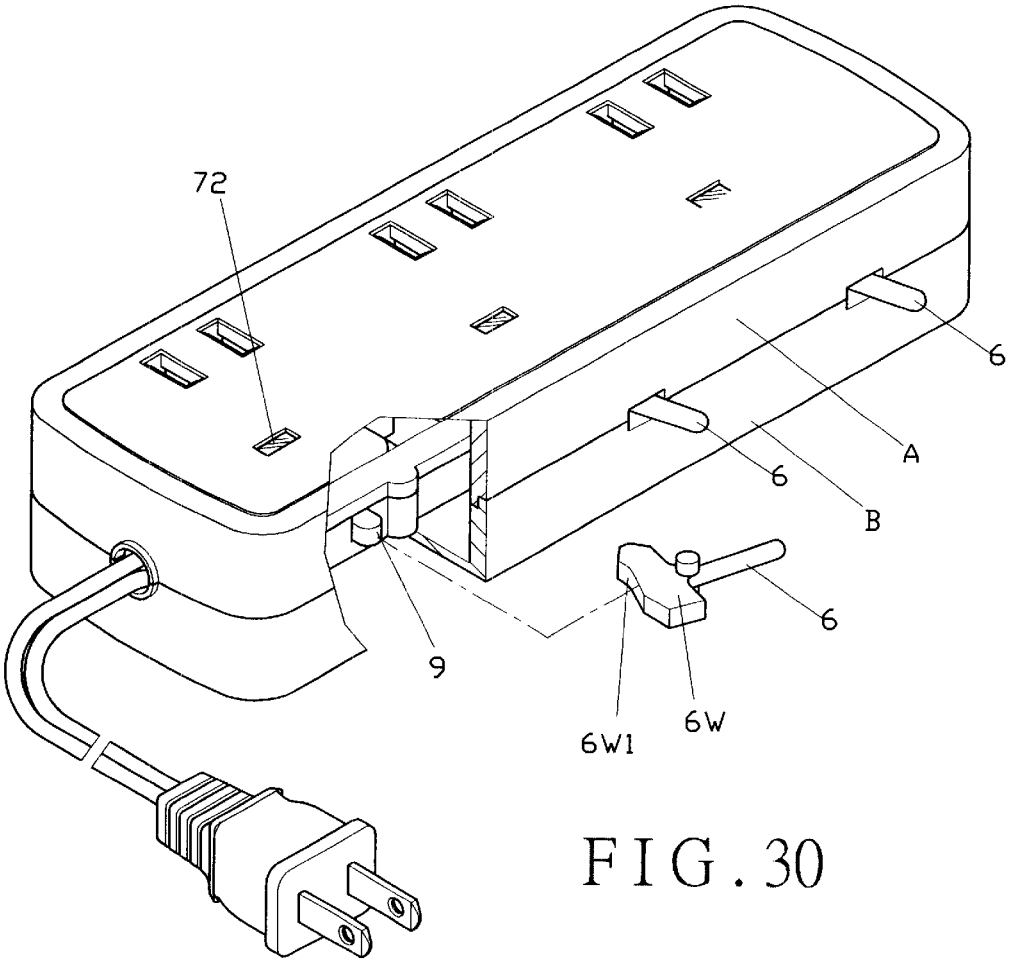
FIG. 30 is a schematic drawing of the base module matched with the switch components (13) of the present invention.
Figure 31:
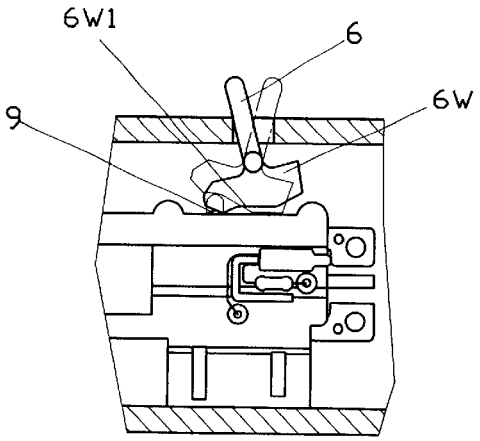
FIG. 31 is an implementation drawing of the base module matched with the switch components (13) of the present invention.

M. As shown in FIGS. 30 and 31, the component (6) is a swing-type rocking bar with the bottom side of the bar body molded into a retaining plate (6W) with concave edge (6W1), the concave edge (6W1) and the plate end push against the link member (9) to project the outer end thereof.

Figure 32:
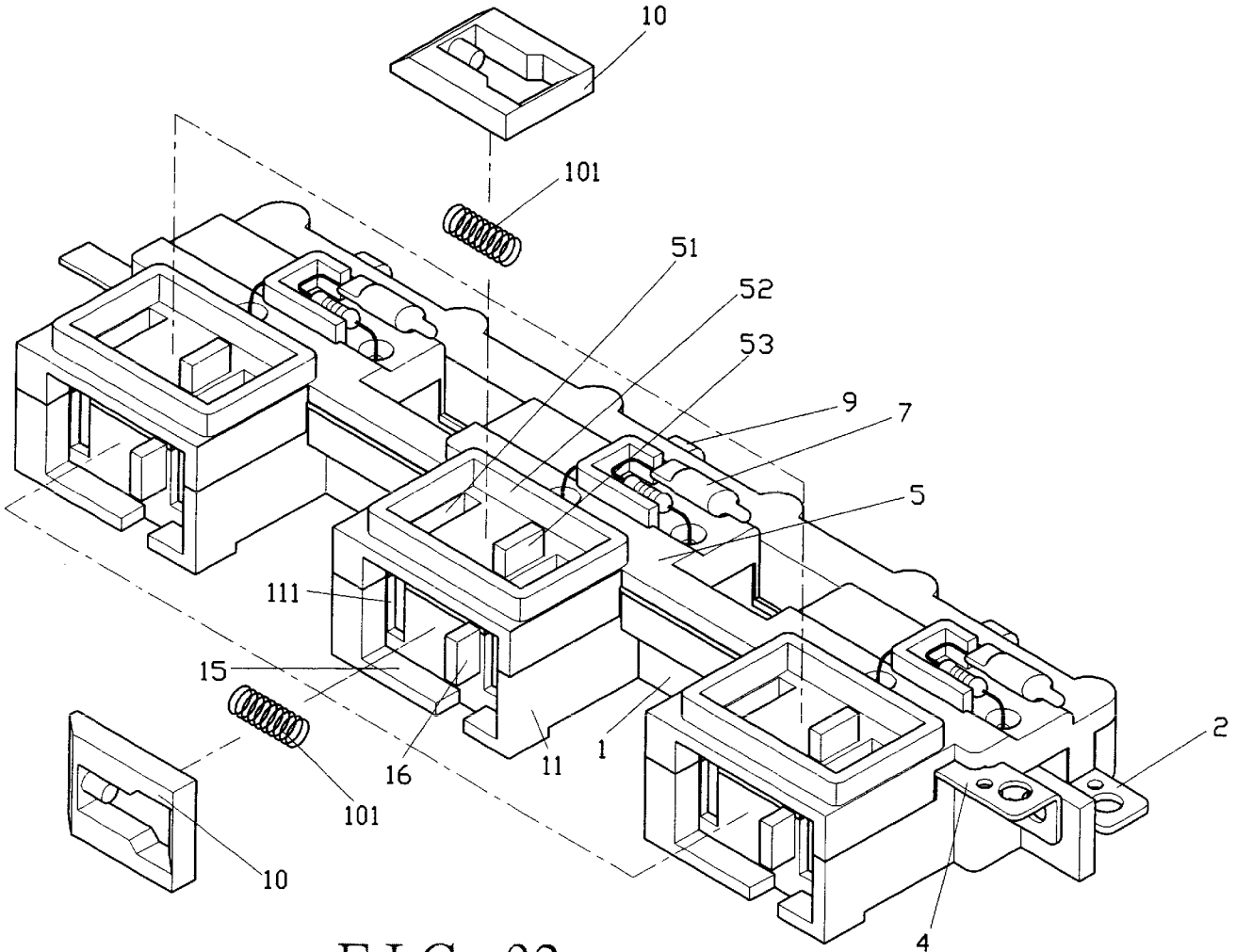
FIG. 32 is a schematic drawing of the base module matched with the protective cover of the present invention.

In addition, as shown in FIG. 32, the area of the top plane of the seat cover (5) covered on the seat body (1) and relative to the receiving slot (11) and the area of the outer lateral plane of the receiving slot (11) of the seat body (1) can both be molded into proper bulged flange bodies (52, 15) to from a receiving section for assembling and connecting the protective cover (10) shielded and blocked at the plug holes (51, 111), after adding the assembly of the receptacle shell members, the protective cover (10) is situated between the receptacle shell members and the seat body (1) to form a safe protective structure as the state indicated in the Figure, the stop blocks (53, 16) are disposed on the top plane of the seat cover (5) inside the flange bodies (52, 15) and the outer lateral plane of the seat body (1) for providing the pressing and fixing of the elastic element (101) fitted and conjoined with the protective cover (10); furthermore, the bulged flange bodies (52, 15) for the receiving section of the protective cover (10) can also be directly molded onto the inner bottom plane of the upper shell member (A) of the receptacle.

Based on the mentioned above, the implemented embodiment of the present invention possesses the following superiorities:

1. To enable the devices of the external power supply unit (such as the extension cord receptacle) to provide the options of multidirectional insertion for the power supply plugs.
2. To efficiently simplify the volume of the receptacle to maintain the modular feature of small volume even after being attached by the switch components.
3. The conducting strips of the present invention can be further extended to form the control section for interrupting and conducting the receptacle circuit and can be used by the external touch member of the switch components in any form to control the power supply of the receptacle.
4. It is not limited by the height of the already available switch components, therefore, the switch structure can be narrower and thinner and made into multiplex changes without influencing the embodiment safety.
5. To make the switch position of the extended power supply unit more variable.
6. To enable the desired alternation for the switch style and formation of the extended power supply unit.
7. The sandwich space can be predetermined at the plug hole area of the receptacle to facilitate the selection of installing the protective cover of the plug holes in multiple forms.

8. The sandwich space possessed at the plug hole area of the receptacle can be in an open state during the assembling process to make the protective cover installation become simpler.

9. The receptacle itself can possess the power indication function of optional state and the disposition location of the power indicator light can be flexible.

10. The conducting strips among the compound receptacle can be molded unitarily without any malconnection at all.

11. The manufacturing process of the receptacle provides rapider assembling procedure.

12. The external power supply unit can easily conduct multiplex production and separate from the traditional style.

13. To possess the modular function, multiple subsidiary elements can be selectively installed and the grades of the devices can be easily distinguished into multiplicities.

In summation of the foregoing sections, a modularized compound receptacle structure of an external power supply unit provided by the present invention utilizes a compound seat body to make a proper assembly of several conducting strips of the power supply unit to form a modularized assembling method that not only makes the insertion construction composed by the conducting strips possess the multidirectional options, but also makes the matched disposition of the subsidiary elements such as the switch components, power indicator light or the protective cover can be coordinated multi-dimensionally, and is capable of efficiently reducing the volume of the power supply unit and the manufacturing procedure; the entire structure has been completely and perfectly programmed and possesses extreme industrial value, has not been previously disclosed in the same industry with the same technical method for manufacturing the receptacle; the preset invention is practical, innovative, fully complies with all new patent application requirements and regulations and is hereby submitted to the patent bureau for review and the granting of the commensurate patent rights.

What is claimed is:

1. A switched multiple power outlet strip, comprising:

a longitudinally extended seat body having a lapping member projecting therefrom, said seat body having a plurality of sets of receiving slots, each of said sets of receiving slots having a first receiving slot and a second receiving slot;

a longitudinally extended first conducting strip fixedly secured to said lapping member, said first conducting strip having a plurality of first electrical contacts projecting therefrom, each of said first electrical contacts being disposed in correspondence to a respective one of said sets of receiving slots;

a plurality of second conducting strips respectively disposed in said first receiving slot of each of said plurality of sets of receiving slots, each of said second conducting strips having a first insert portion formed on one end thereof for electrical contact with a corresponding prong of a plug, and a contact portion formed on an opposing end of said second conducting strip and extending onto said lapping member, said contact portion being spaced from said first conducting strip and having a second electrical contact formed thereon in correspondence with a respective first electrical contact of said first conducting strip;

a longitudinally extended third conducting strip having a plurality of second insert portions extending transverse said longitudinal direction and respectively disposed in said second receiving slots of said plurality of sets of receiving slots;

a plurality of conducting members disposed on said lapping member for respectively selectively electrically connecting a corresponding pair of said first and second electrical contacts;

a housing enclosing said seat body and having a plurality of pairs of slotted openings corresponding to said sets of receiving slots of said seat body for defining a plurality of electrical outlet positions, said housing having a plurality of switch operators displaceably mounted therein for selective displacement of said plurality of conducting members; and, a power cable extending through said housing and having first and second electrical leads in respective electrical communication with said first conducting strip and said third conducting strip, whereby a user may selectively energize and de-energize any of said electrical outlet positions by displacement of a corresponding one of said switch operators to displace a respective one of said conducting members.

2. The switched multiple power outlet strip as recited in claim 1, further comprising a longitudinally extended seat cover overlaying at least a portion of said seat body, said seat cover being disposed in overlaying relationship with said third conducting strip and having a plurality of plug holes formed therethrough in aligned relationship with said first and second receiving slots.

3. The switched multiple power outlet strip as recited in claim 1, wherein each of said conducting members is reciprocally displaced into and out of contact with a corresponding pair of said first and second electrical contacts responsive to reciprocal displacement of a corresponding one of said switch operators.

4. The switched multiple power outlet strip as recited in claim 1, wherein each of said conducting members is reciprocally displaced into and out of contact with a corresponding pair of said first and second electrical contacts responsive to rotative displacement of a corresponding one of said switch operators.

5. The switched multiple power outlet strip as recited in claim 1, wherein each of said switch operators includes a link member disposed adjacent a corresponding conducting member for displacing said conducting member, and a button body having a portion thereof disposed adjacent said link member and extending through said housing for selective displacement of said link member.

6. The switched multiple power outlet strip as recited in claim 1, further comprising a plurality of indicator lights respectively disposed adjacent said plurality of electrical outlet positions and visible through said housing, each of said indicator lights being electrically coupled between said third conducting strip and a respective one of said plurality of second conducting strips for indicating energization of a corresponding electrical outlet position.

7. The switched multiple power outlet strip as recited in claim 6, wherein each of said plurality of indicator lights includes a pair of contact feet extending therefrom for respective insert into corresponding openings formed in said third conducting strip and said respective one of said second conducting strips.

8. The switched multiple power outlet strip as recited in claim 2, further comprising a plurality of indicator lights respectively disposed on said seat cover adjacent said plurality of electrical outlet positions and visible through said housing, each of said indicator lights being electrically coupled between said third conducting strip and a respective one of said plurality of second conducting strips for indicating energization of a corresponding electrical outlet position.

9. The switched multiple power outlet strip as recited in claim 8, wherein each of said plurality of indicator lights includes a pair of contact feet extending therefrom for respective passage through openings formed in said seat cover and insert into corresponding openings formed in said third conducting strip and said respective one of said second conducting strips.

10. The switched multiple power outlet strip as recited in claim 1, further comprising a plurality of protective covers disposed between said seat body and said housing, each of said protective covers being slidably disposed and elastically biased over a respective one of said plurality of sets of receiving slots.

* * * * *